US005582245A

United States Patent [19]

Niimi

[11] Patent Number: 5,582,245

[45] Date of Patent: Dec. 10, 1996

[54] HEAT EXCHANGER

[75] Inventor: Tomio Niimi, Nagoya, Japan

[73] Assignees: Kankyokagakukogyo Kabushiki Kaisha; Hitoshi Imai, both of Nagoya, Japan

[21] Appl. No.: 442,490

[22] Filed: May 16, 1995

[30] Foreign Application Priority Data

May 17, 1994 [JP] Japan ..... 6-128292

[51] Int. Cl.[6] ..... F28F 3/00

[52] U.S. Cl. ..... 165/166; 165/165; 165/157; 165/154

[58] Field of Search ..... 165/157, 154, 165/166, 165, 164

[56] References Cited

U.S. PATENT DOCUMENTS

| | | | |
|---|---|---|---|
| 1,231,842 | 7/1917 | Van Den Bos | 165/154 |
| 4,351,391 | 9/1982 | Eberhardt | 165/164 X |
| 4,369,835 | 1/1983 | Goudy, Jr. | 165/154 |
| 4,995,454 | 2/1991 | Thompson | 165/154 X |

FOREIGN PATENT DOCUMENTS

| | | | |
|---|---|---|---|
| 370173 | 1/1907 | France | 165/154 |
| 1367918 | 6/1964 | France | 165/154 |
| 0125391 | 7/1984 | Japan | 165/154 |
| 338212 | 6/1959 | Switzerland | 165/154 |
| 342701 | 2/1931 | United Kingdom | 165/157 |

*Primary Examiner*—John Rivell
*Assistant Examiner*—Christopher Atkinson
*Attorney, Agent, or Firm*—Flynn, Thiel, Boutell & Tanis, P.C.

[57] ABSTRACT

A heat exchanger for enhancing thermal efficiency between two fluids and lengthening a fluid passage so as to increase contact surfaces between heat exchanger and fluids and permitting the heat exchanger to be compact as a whole. The heat exchanger includes a combination of first and second heat exchanger units respectively comprising larger and smaller diameter discs on which small chambers, which are open at fronts thereof and communicate with one another, are provided, so as to permit the fluids to perform striking, dispersing and meandering operations.

7 Claims, 12 Drawing Sheets

HEAT EXCHANGER

BACKGROUND OF THE INVENTION

1. Field of the Invention

The present invention relates to a heat exchanger for improving heat exchanger effectiveness between fluid of high temperature and that of low temperature and enhancing compactness thereof.

2. Description of Related Art

Various heat exchangers of this type are known so far. For example, firstly a multitube type heat exchanger having bundle of tubes disposed inside a cylindrical vessel for performing heat exchange by flowing two fluids in each tube and the cylindrical vessel, secondly a coil type heat exchanger having a coil formed of a helically winding tube or a spiral tube or many straight pipes coupled by curved pipes and disposed and soaked inside a vessel for performing heat exchange between two fluids inside the tube and vessel, thirdly a spiral type heat exchanger having two parallel flat plates which are wound helically and disposed inside an airtight cylinder for performing heat exchange between two fluids while swirling two fluids, fourthly a plate type heat exchanger having thin corrugated plates which are laid one on the other and fastened so as to permit two fluids to flow alternately to chambers defined between spaces of corrugated plates, and fifthly a fin tube type heat exchanger having fins on an outer wall of a circular pipe.

However, in either of the heat exchangers, heat exchange can be performed between the pipe, plates or fins and surface layer of the flowing fluid, and hence the fluid has no irregularity in its temperature distribution during the flowing thereof and quantity of fluid which does not contact the heat transfer surface is larger so that thermal efficiency is deteriorated. Further, since the thermal conductivity is determined by a heat transfer area of mere pipes, corrugated plates, fins, such heat exchangers has drawbacks in that number of pipes is increased and the corrugated plates are enlarged for enhancing the thermal conductivity for enhancing thermal efficiency.

SUMMARY OF THE INVENTION

It is therefore an object of the present invention to provide a heat exchanger capable of enhancing thermal conductivity between two fluids by striking, dispersing and meandering the two fluids radially and centripetally, lengthening a fluid passage by permitting a continuous fluid passage to be zigzag so as to increase contact surfaces, thereby permitting the heat exchanger to be compact as a whole. Further object is to provide a heat exchanger comprising a heat exchanger unit which can be used as a single unit or continuously coupling units and capable of reducing loss of heat energy at a time of heat exchange therein.

In view of the problems of the thermal conductivity enhancing means which depends on only the increase of the heat transfer area of the prior art heat exchangers, it is an object of the present invention to provide a heat exchanger having a combination of first and second heat transfer units respectively comprising larger and smaller diameter discs on which small chambers, which are open at fronts thereof, are provided, wherein fluids perform striking, dispersing and meandering operations so as to enhance the thermal conductivity, and further a fluid passage is lengthened so as to permit the heat exchanger to be compact as a whole.

A heat exchanger composed of first and second transfer units for permitting two fluids having a high temperature and a low temperature to flow therethrough respectively is inserted into a casing.

The first heat transfer unit concentrically comprising two pairs of a larger and a smaller diameter discs each having a plurality of polygonal small chambers thereon which are open at fronts thereof, in each pair the larger and smaller diameter discs being coupled to each other face to face, wherein the small chambers of the larger diameter disc and those of the smaller diameter disc are alternately arranged with one another so as to communicate with one another and the larger and smaller diameter discs have through holes formed at centers thereof respectively, the through holes being smaller than the through holes in diameter;

The second heat transfer unit concentrically comprises two pairs of larger and smaller diameter discs like the first heat transfer unit, wherein the smaller diameter discs having pipe attaching holes at centers thereof are concentrically coupled to each other back to back, a closing plate provided between peripheries of said larger diameter discs positioned at both sides of said second heat transfer unit to form a fluid passage 11 between said closing plate and peripheries of said smaller diameter discs, the attaching holes are smaller in diameter than the through holes of the larger diameter discs of the first heat transfer unit.

The second heat transfer units are positioned at the center of the heat exchange unit and rear side surfaces of the smaller diameter discs of the first heat transfer unit are concentrically coupled to rear side surfaces of the larger diameter discs of the second heat transfer unit.

When the heat exchange unit is inserted into the casing to bring the peripheries of the larger diameter discs of the first heat transfer unit into close contact with an inner periphery of the casing 9 so as to form a fluid passage between the closing plate and the inner periphery of the casing, and second inlet and outlet pipes 15 attached to the attaching holes for permitting fluids to flow into or out of the second heat transfer unit so as to pass through the through holes of the smaller and larger diameter discs of the first heat transfer unit respectively.

One of the surfaces of the smaller diameter discs of the second heat transfer unit where they are coupled to each other is concave and the other is convex so as to be brought into closer contact with each other, and ones of rear surfaces of the larger diameter discs of the second heat transfer unit and the smaller diameter discs of the first heat transfer unit in the heat exchanger where they are coupled to each other are concave and the others thereof are convex so as to be brought into closer contact with each other.

Two smaller diameter discs of the second heat transfer unit is replaced with a single smaller diameter disc and each pair of the larger diameter discs of the second heat transfer unit and the smaller diameter discs of the first heat transfer unit which are coupled to each other in the heat exchanger is replaced with a single disc.

PREFERRED EMBODIMENT OF THE INVENTION

First Embodiment (FIGS. 1 to 7)

Figure 1:
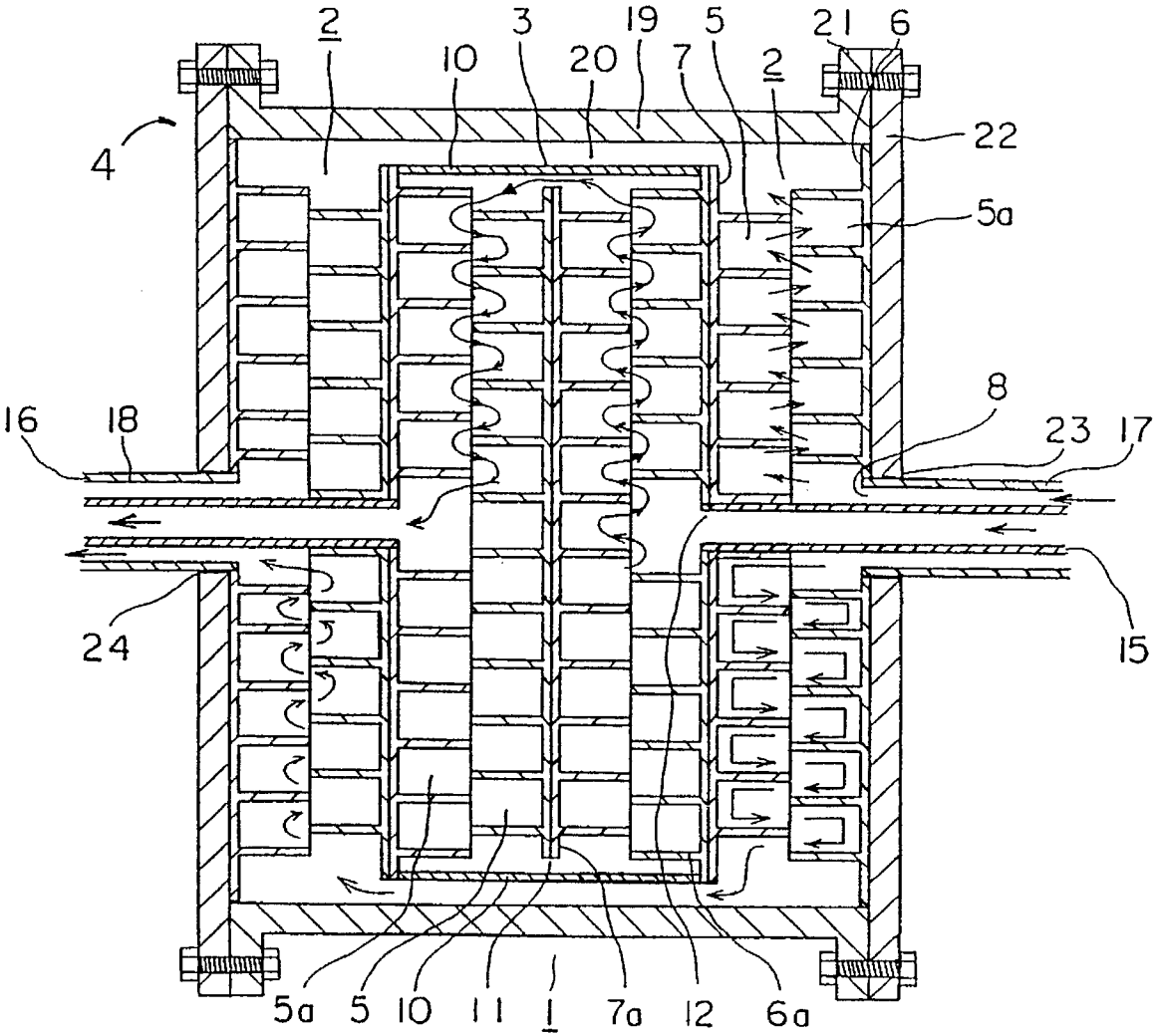
FIG. 1 is a cross-sectional view of a heat exchanger according to a first embodiment of the present invention.
Figure 2:
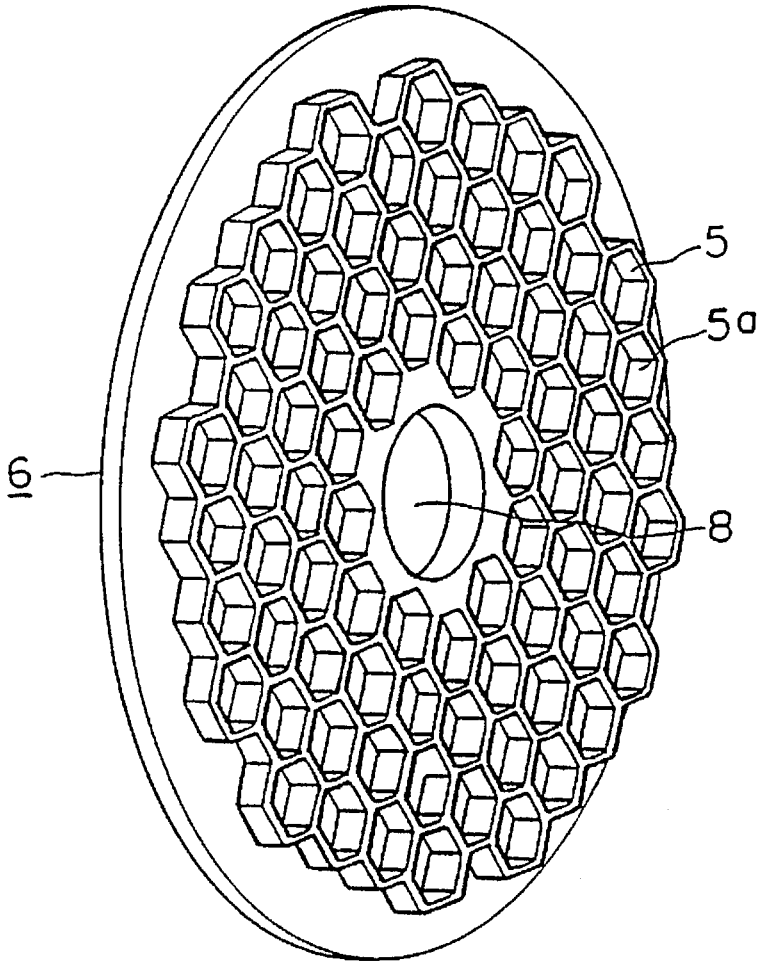
FIG. 2 is a perspective view of a larger diameter disc constituting a first heat transfer unit.
Figure 3:
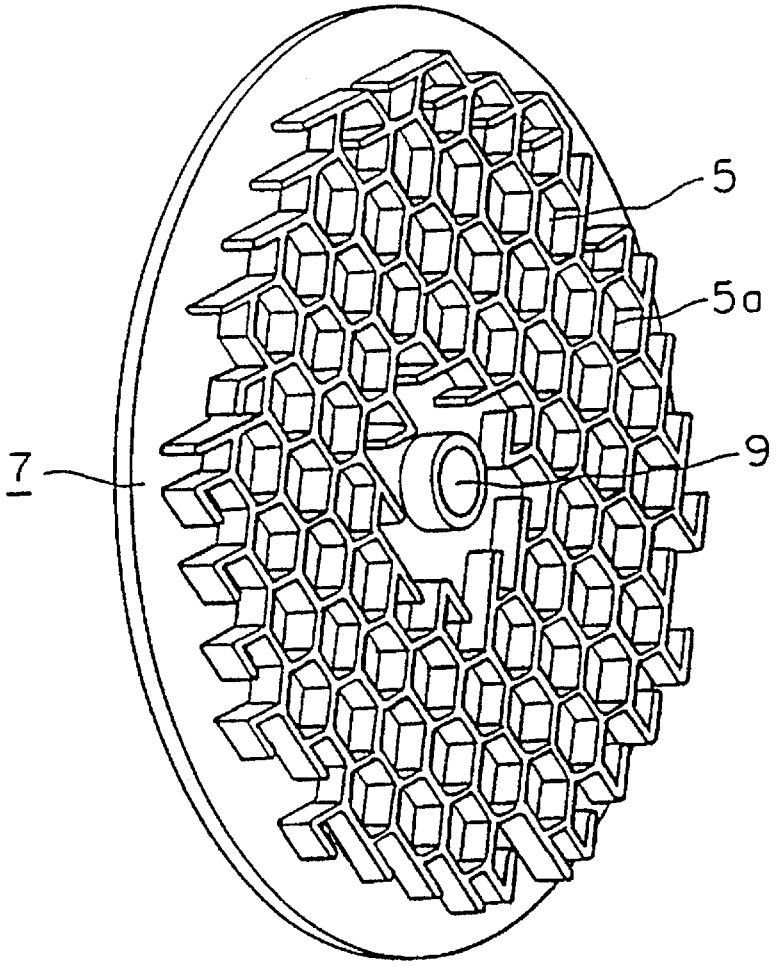
FIG. 3 is a perspective view of a smaller diameter disc constituting the first heat transfer unit.
Figure 4:
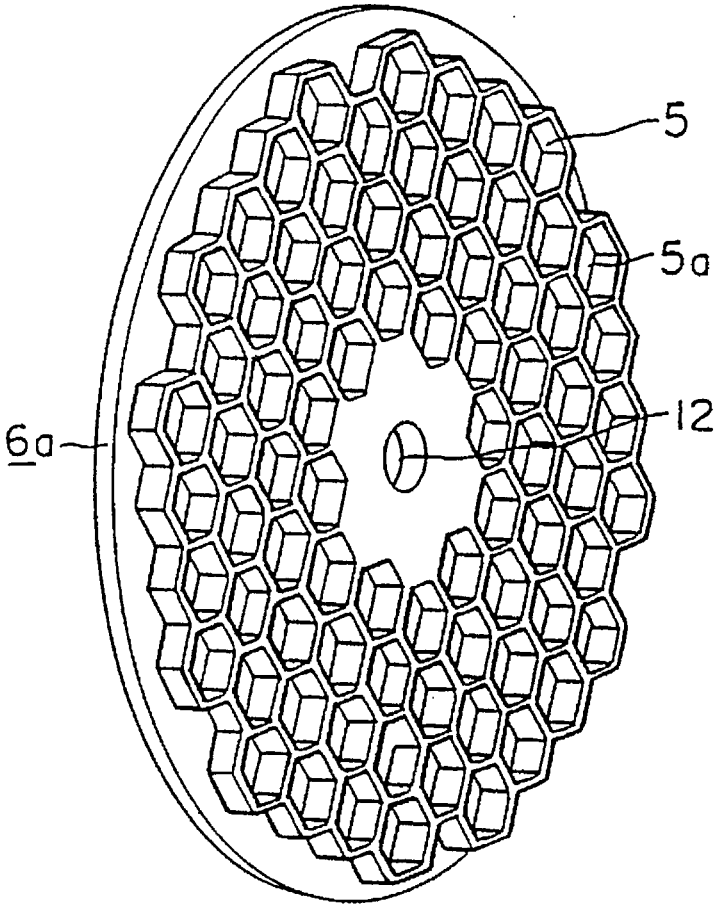
FIG. 4 is a perspective view of a larger diameter disc constituting a first heat transfer unit.
Figure 5:
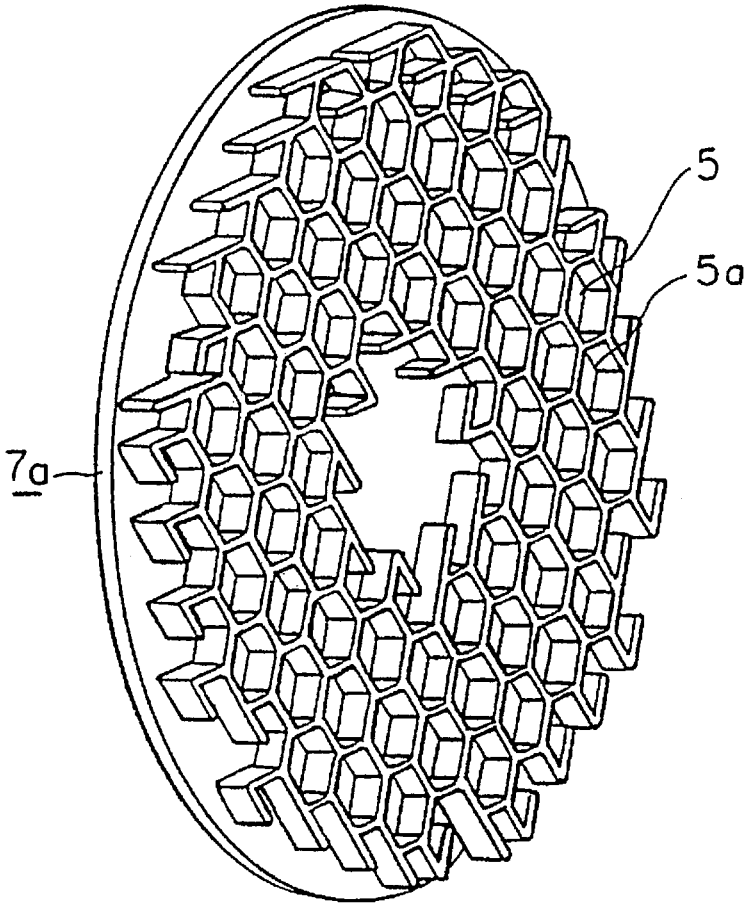
FIG. 5 is a perspective view of a smaller diameter disc constituting the first heat transfer unit.
Figure 6:
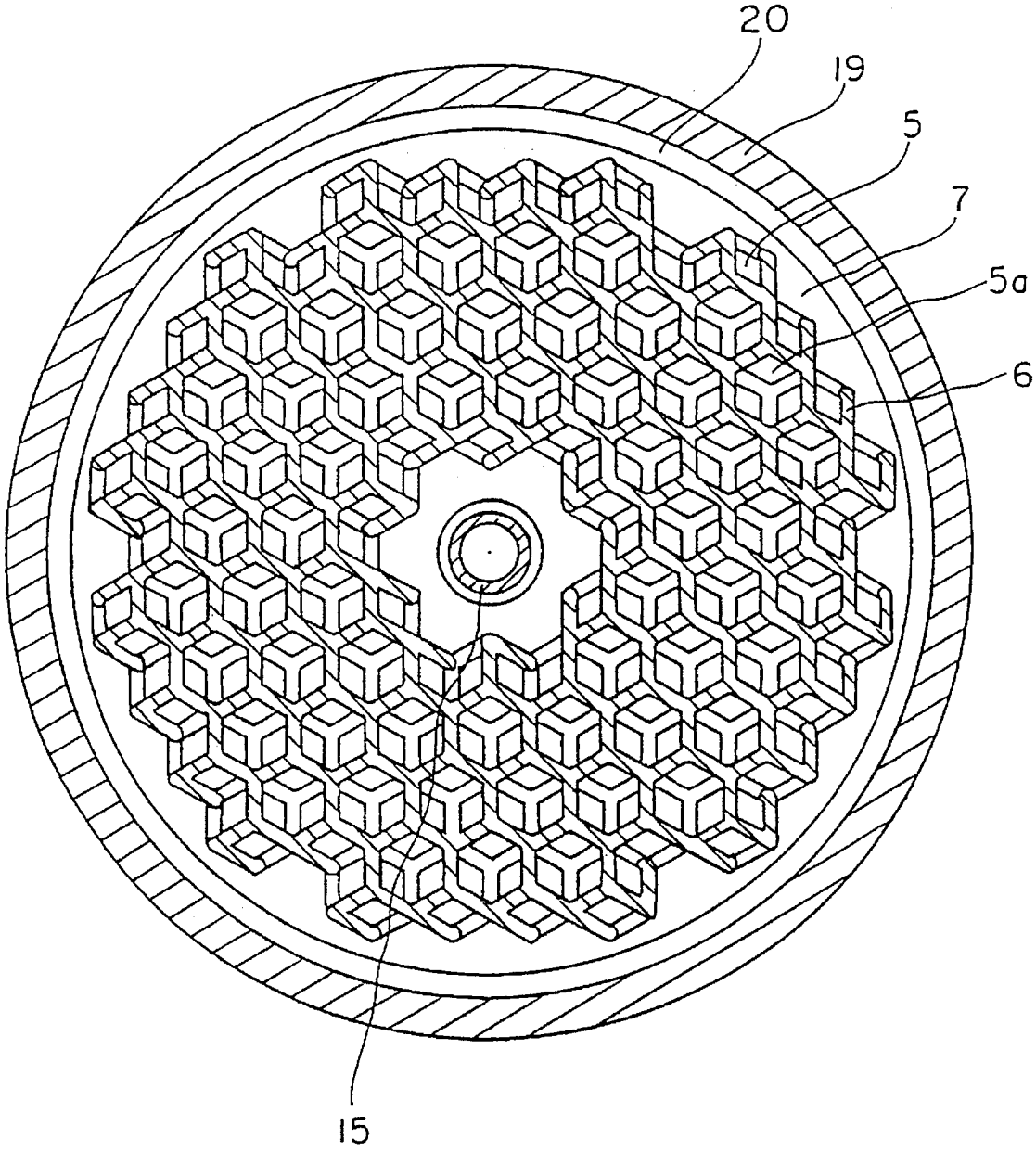
FIG. 6 is a cross-sectional view showing a main part of the heat exchanger.
Figure 7:
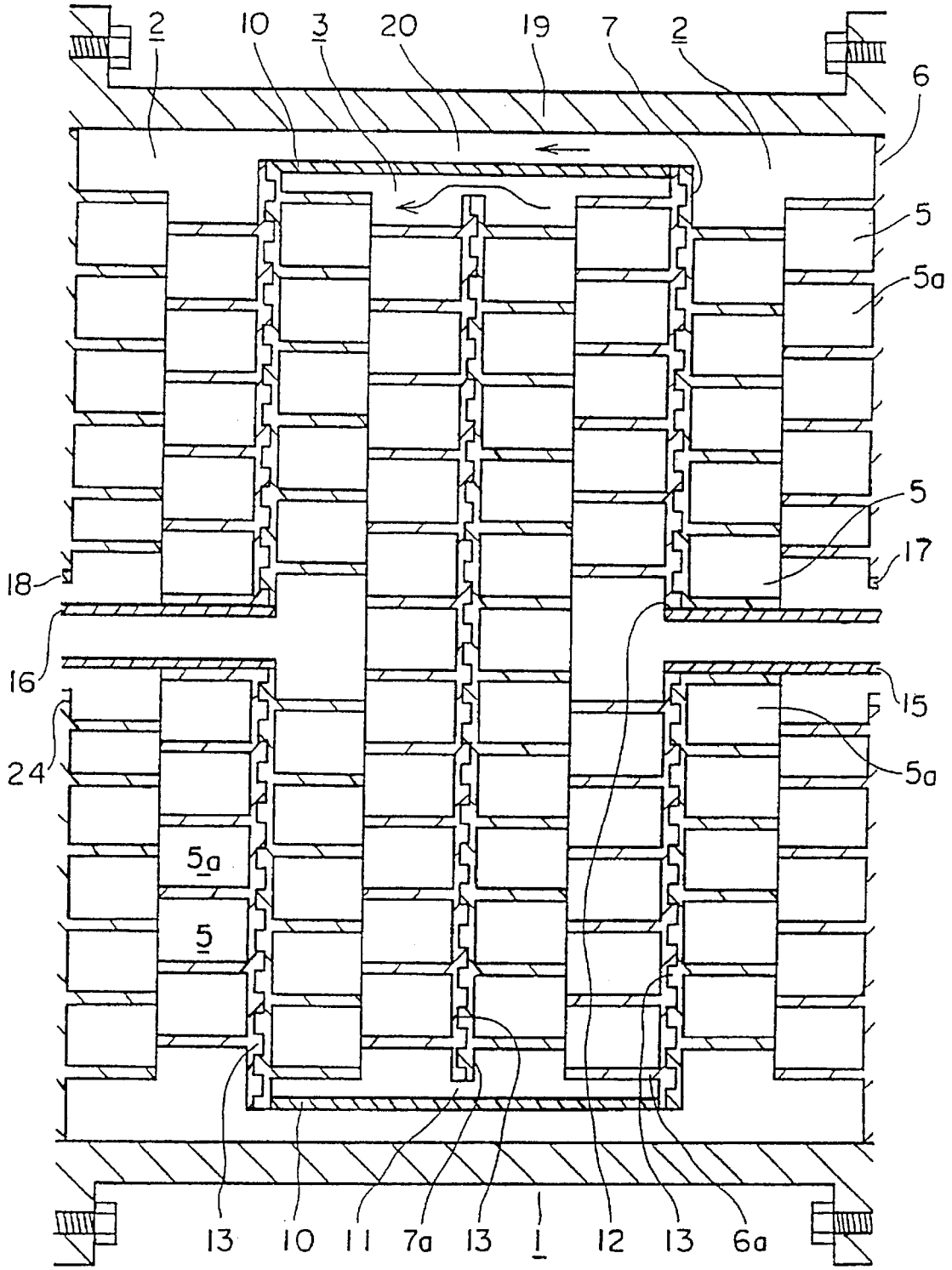
FIG. 7 is a cross-sectional view showing a main part of the heat exchanger.

A first embodiment of the present invention will be described with reference to FIG. 1 to 7.

Denoted at 1 is a heat exchanger composed of a single heat exchanger unit 4 or a plurality of heat exchanger units 4 which are joined to each other, so as to perform heat exchange between two fluids comprising high temperature fluid and low temperature fluid. The heat exchanger unit 4 comprises a first heat transfer unit 2 for permitting one of two fluids to flow therethrough and a second heat transfer unit 3 for permitting the other of two fluids to flow therethrough.

It is a matter of fact that the first heat transfer unit 2 and second heat transfer unit 3 are preferable to be made of metal having high thermal conductivity since it is intended for heat exchange.

First, the first heat transfer unit 2 comprises a pair of two discs, namely, a larger diameter disc 6 and a smaller diameter disc 7 which are paired centripetally and brought into closer contact with each other watertightly. Polygonal small chambers 5, 5*a* . . . are provided on front surfaces of the larger diameter disc 6 and smaller diameter disc 7 which face each other and they are open at the front thereof.

As shown in FIG. 1, the small chambers 5, 5*a* . . . of the larger diameter disc 6 and the small chambers 5, 5*a* . . . of the smaller diameter disc 7 are arranged alternately so as to communicate with one another.

In the first embodiment, the small chambers 5, 5*a* . . . are hexagonal as viewed from plane thereof and arranged in honeycomb. However, the small chambers 5, 5*a* . . . are not limited to such a hexagonal shape but each of them may be triangular, square, octagonal, etc. wherein functions of the small chambers 5, 5*a* . . . are not varied.

Through holes 8 each having a larger diameter are formed through the centers of the larger diameter discs 6 and through hole 9 each having a smaller diameter are formed through the centers of the smaller diameter discs 7.

The second heat transfer unit 3 comprises, as shown in FIGS. 1, 4, 5 and 6, a pair of larger disks 6*a* provided at both sides thereof and smaller diameter discs 7*a* provided at the center thereof and they are respectively smaller than the larger diameter disc 6 and smaller diameter disc 7 of the first heat transfer unit 2 in their diameters, wherein back surfaces of the smaller diameter discs 7*a* are arranged concentrically with and brought into closer contact with each other watertightly and closing plates 10 are provided between peripheries of the larger diameter discs 6*a* at the front thereof. Further, a fluid passage 11 is defined between inner peripheral surfaces of the closing plates 10 and both peripheries of the smaller diameter discs 7*a*.

In the first embodiment, although closing plates 10 are provided separately from both larger diameter discs 6*a*, they may be circumferentially integrally provided on one larger diameter disc 6*a* or both larger diameter discs 6*a* so as to project from the outer periphery or surfaces at the front side thereof. In this case, it is a matter of course that projecting dimensions of each larger diameter disc 6*a* are reduced.

Pipe attaching holes 12 are formed through the larger diameter disc 6*a* at the centers thereof each diameter of which is smaller than that of the through hole 8 of the larger diameter disc 6.

It is preferable to form concave portions on the back surface of one smaller diameter disc 7*a* and to form convex portions on the back surface of the other smaller diameter disc 7*a* so that the concave and convex portions 13 are alternately brought into closer contact with one another so as to enhance the thermal efficiency.

Although two smaller diameter discs 7*a* are employed in the first embodiment, single smaller diameter disc 7*a* having small chambers 5, 5*a* . . . at the front and back surfaces thereof may be employed for removing loss of thermal efficiency at both surfaces of the single smaller diameter disc 7*a*.

The second heat transfer unit 3 can be structured to be disassembled by fastening both larger diameter discs 6*a* by screws.

As the heat exchanger unit 4, the second heat transfer unit 3 is positioned at the center thereof and the first heat transfer unit 2 is attached to the second heat transfer unit 3 in such a way that the back surface of the smaller diameter disc 7 constituting the first heat transfer unit 2 is brought into closer contact with that of the larger diameter disc 6*a* constituting the second heat transfer unit 3.

Each end of second inlet and outlet pipes 15 is attached watertightly to each pipe attaching hole 12 formed through the larger diameter discs 6*a* of the second heat transfer unit 3 for permitting one of high and low temperature fluids to flow into the second inlet pipe 15 and flow out from the second outlet pipe 15. The second inlet and outlet pipes 15 pass through the through holes 8 and 9 formed through the smaller and larger diameter discs 7 and 6 of the first heat transfer unit 2 and extends outside the first heat transfer unit 2. Each end of a first inlet pipe 17 and a first outlet pipe 18 is watertightly attached to each through hole 8 of the larger diameter disc 6 of the first heat transfer unit 2 for permitting the other of two fluids to flow into the first inlet pipe 17 and to flow out from the first outlet pipe 18, and the first inlet pipe 17 and first outlet pipe 18 are inserted into a pipe inlet 23 and a pipe outlet 24 of the casing 19.

The through holes 9 through which the second inlet and outlet pipes 15 pass watertightly pass through the smaller diameter discs 7 like the pipe attaching hole 12.

The heat exchanger unit 4 having such an arrangement is inserted into a cylindrical hollow space of the casing 19 and the periphery of the larger diameter disc 6 is watertightly brought into closer contact with an inner periphery of the casing 19 so as to form fluid passages 20 between the outer peripheries of the closing plates 10 of the second heat transfer unit 3 and inner peripheries of the casing 19.

A seal member such as an 0 ring (not shown) may be used between the inner periphery of the casing 19 and the periphery of the larger diameter disc 6.

Figure 10:
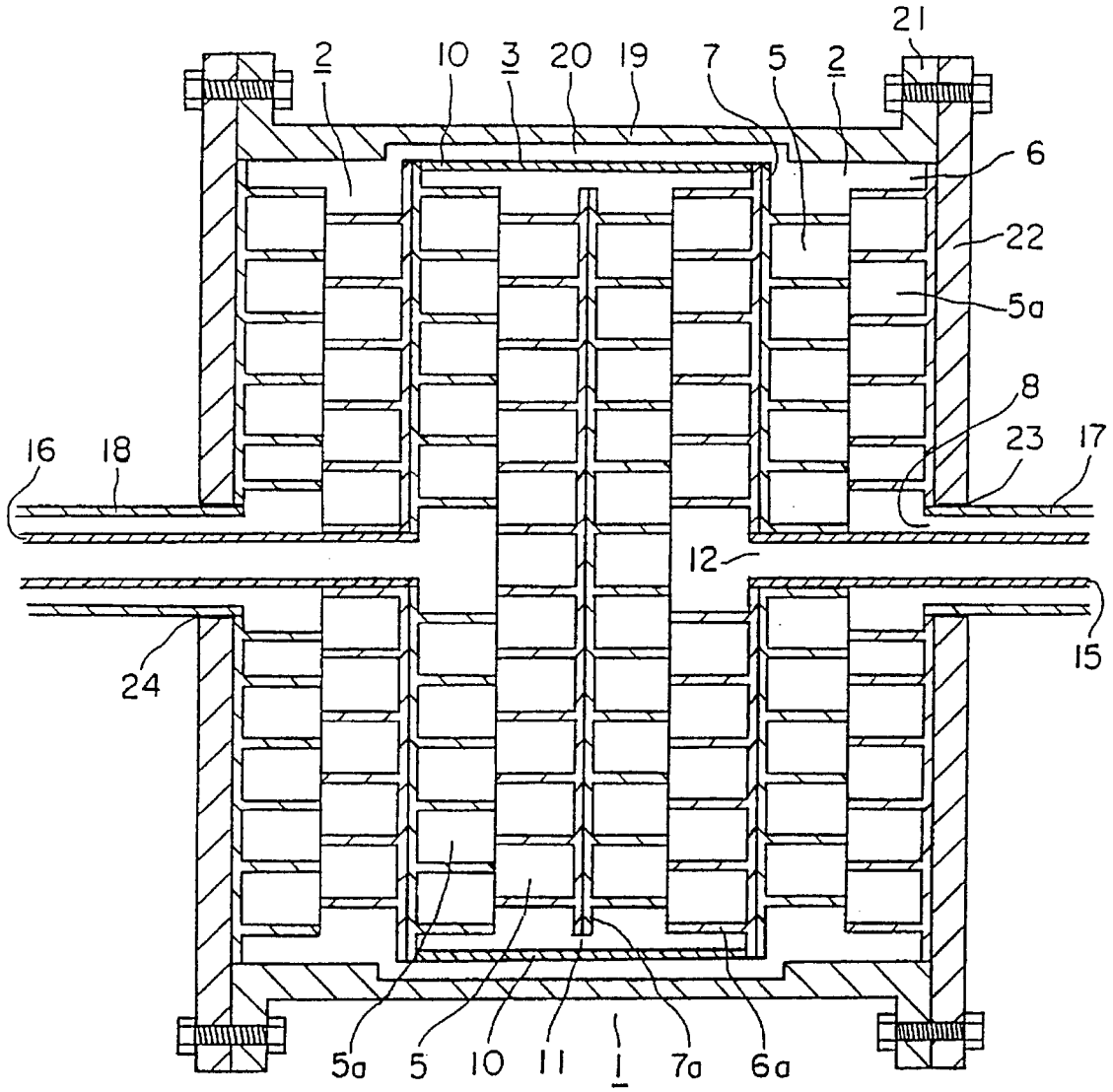
FIG. 10 is a cross-sectional view showing a main part of a heat exchanger according to a third embodiment of the invention.

The fluid passages 20 defined by inserting the heat exchanger unit 4 into the casing 19 are not limited to the first embodiment. For example, it can be formed by enlarging or recessing the inner periphery of the casing 19 at a part corresponding to the outer periphery of the closing plate 10 since the outer periphery of the closing plate 10 of the second heat transfer unit 3 and the inner periphery of the casing 19 is brought into closer contact with each other as shown in FIG. 10 if the diameter of the larger diameter disc 6 of the first heat transfer unit 2 is the same as that of the larger diameter disc 6*a* of the second heat transfer unit 3.

It is also preferable to form concave portions on the back surface of one of the larger diameter disc 6*a* of the second heat transfer unit 3 and the smaller diameter disc 7 of the first heat transfer unit 2 and convex portions on the back surface of the other of the same at a portion where the larger diameter disc 6*a* of the second heat transfer unit 3 and the smaller diameter disc 7 of the first heat transfer unit 2 are brought into closer contact with each other for removing loss of thermal efficiency.

Although the larger diameter disc 6*a* of the second heat transfer unit 3 is formed separately from the smaller diameter disc 7 of the first heat transfer unit 2, they can be replaced by a single unit so as to have respectively small chambers 5, 5*a* . . . at the front and back surfaces thereof, thereby removing loss of thermal efficiency at those portions.

Denoted at 21 is flanges provided at both ends of the casing 19 and projecting circumferentially from openings provided at both ends of the casing 19 and 22 is covers for detachably mounting on the flange 21 wherein the pipe inlet 23 and pipe outlet 24 are respectively formed on the cover 22.

Figure 8:
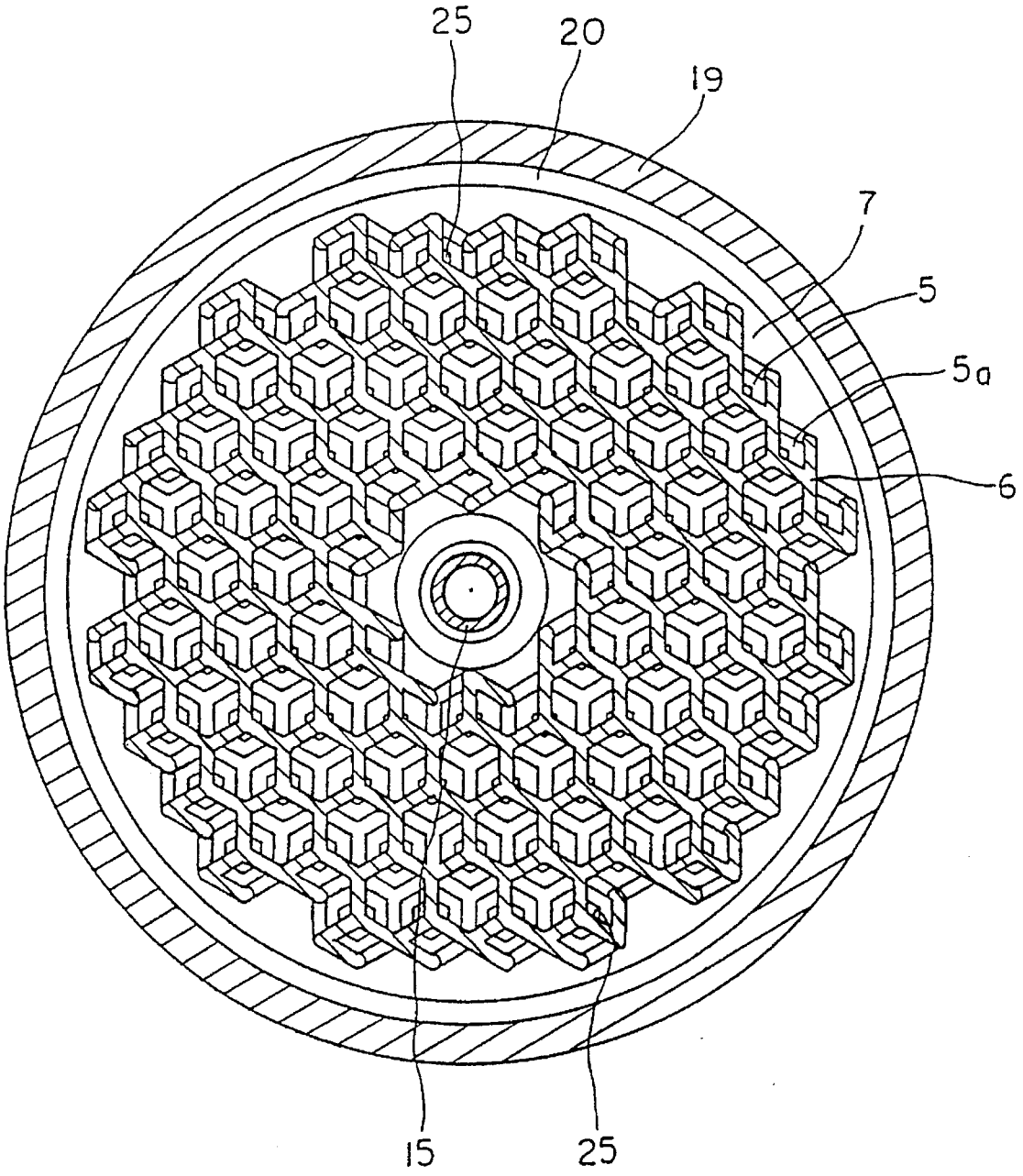
FIG. 8 is a cross-sectional view showing a main part of a heat exchanger according to a second embodiment of the invention.
Figure 9:
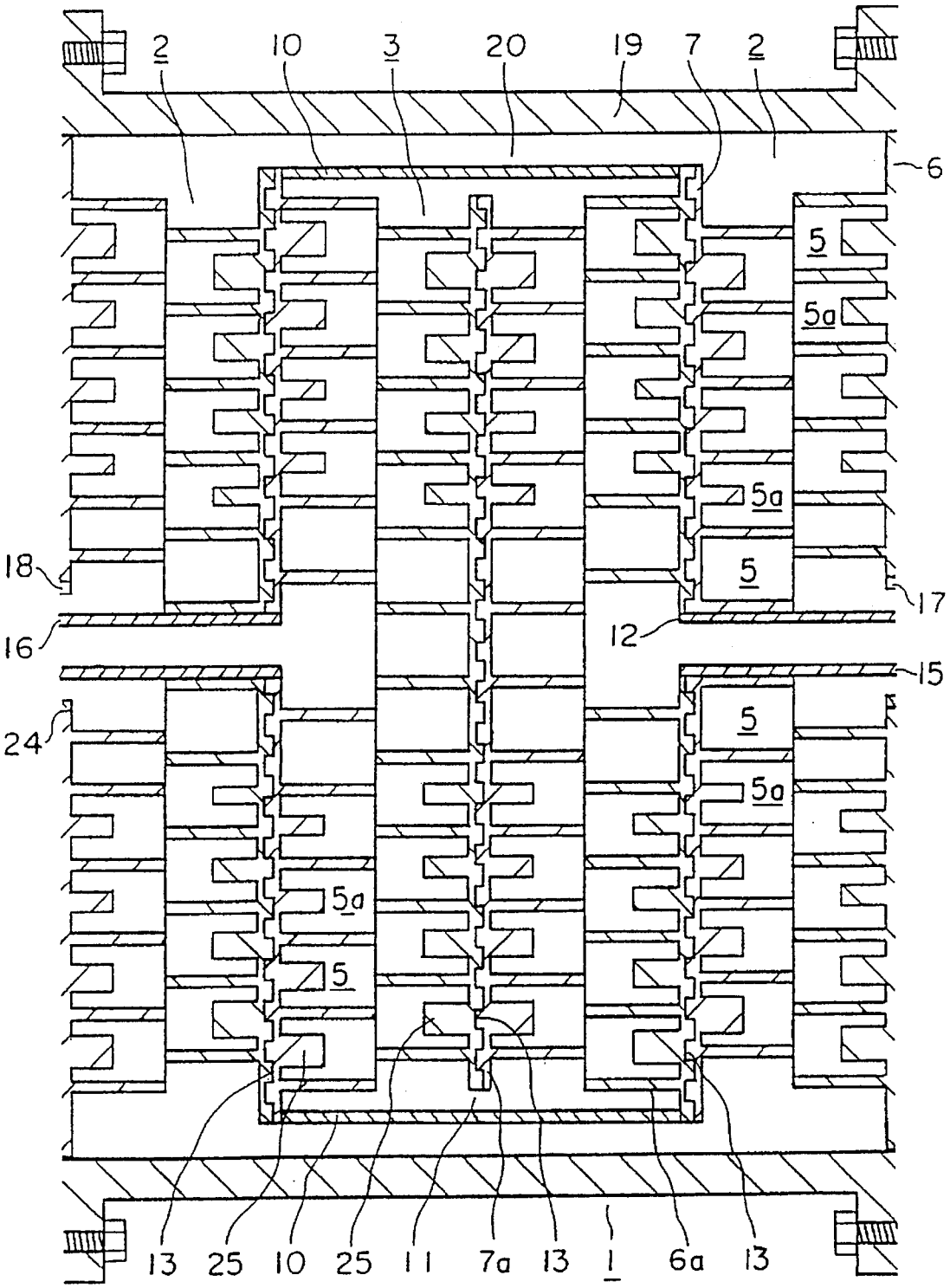
FIG. 9 is a cross-sectional view showing a main part of a heat exchanger according to the second embodiment of the invention.

Second Embodiment (FIGS. 8 and 9)

As shown in FIGS. 8 and 9, projections 25 are respectively formed in the small chambers 5, 5*a* . . . at the central portions on the bottom surface thereof wherein heights of the projections 25 are lower than those of upper surfaces of the small chambers 5, 5*a* . . . excepting the small chambers 5, 5*a* . . . provided at the central portions of the larger and smaller diameter discs 6 and 7 of the first heat transfer unit 2 and at the central portions of the larger and smaller diameter discs 6*a* and 7*a* of the second heat transfer unit 3. The projections 25 are formed to be gradually smaller toward the centers of larger and smaller diameter discs 6, 6*a* and 7, 7*a* of the first and second heat transfer units 2 and 3, thereby positively producing disturbance of the flow of the fluid.

Figure 11:
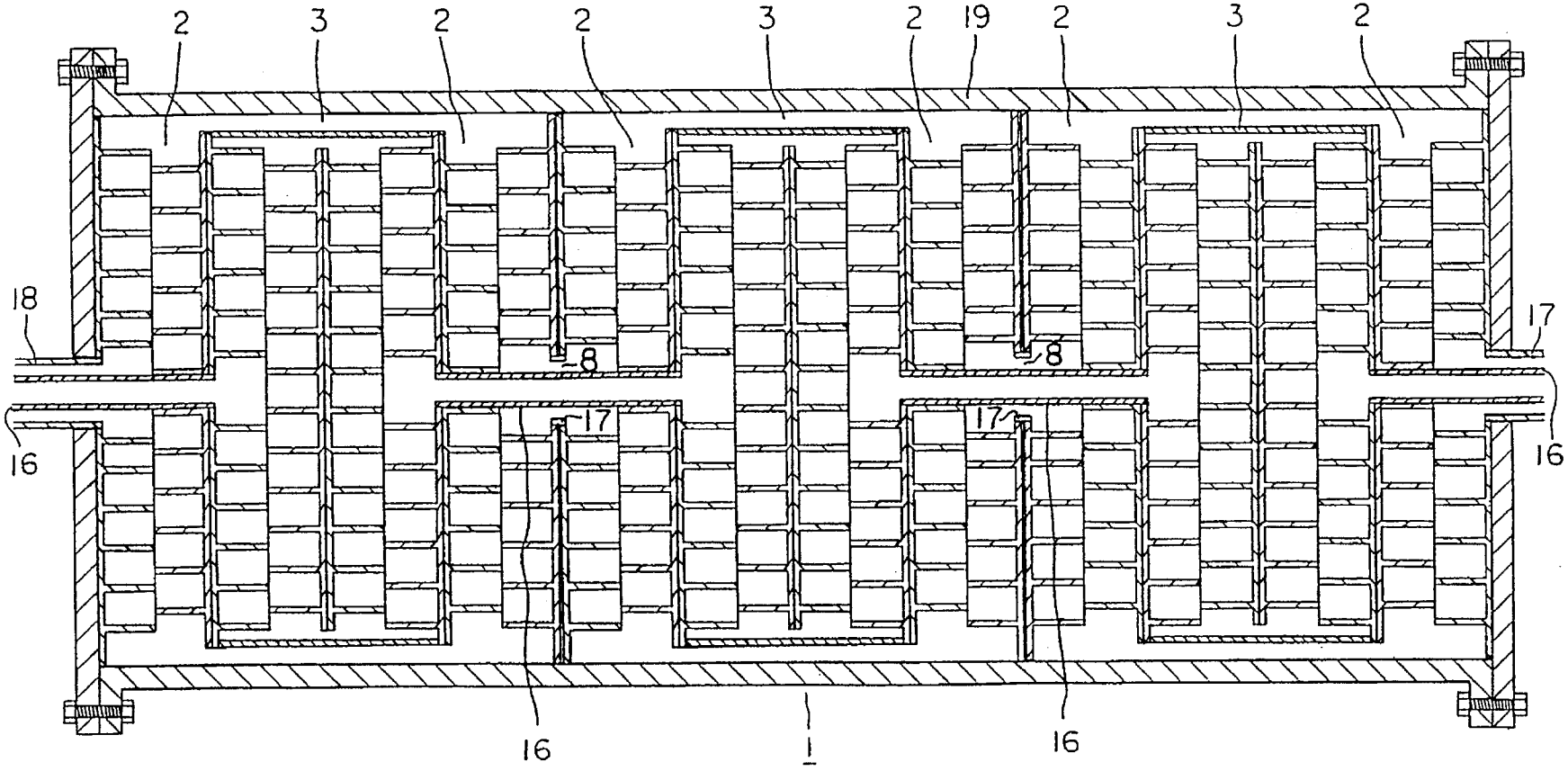
FIG. 11 is a cross-sectional view of heat exchanger using a plurality of heat exchanger units.
Figure 12:
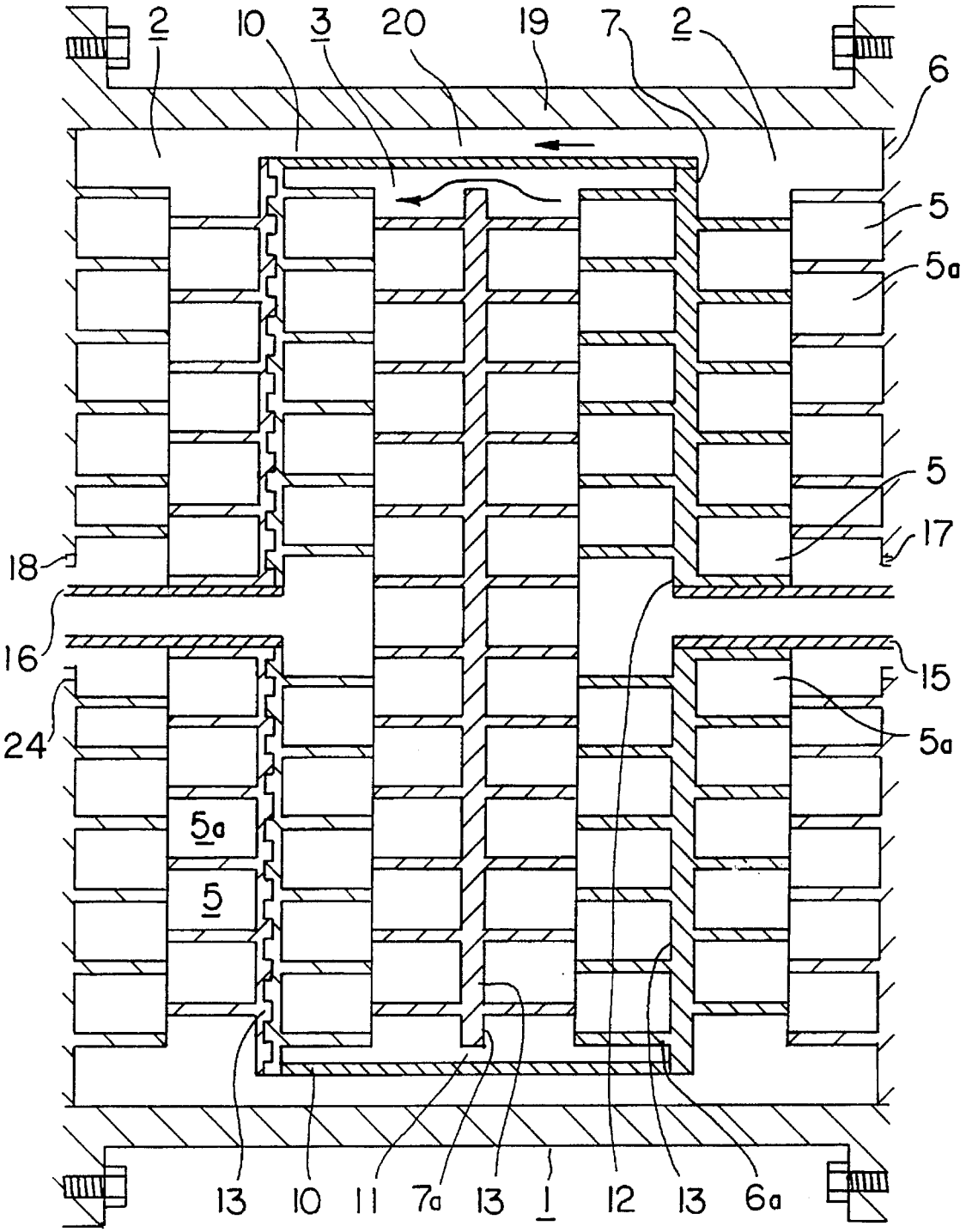
FIG. 12 is a cross-sectional view showing a main part of a heat exchanger with the coupled discs replaced by a single two-sided disc.

The heat exchanger unit 4 is used as a single unit according to the first embodiment, but it can be used as plural ones by coupling them to one another and arranging serially and continuously in the casing 19 as shown in FIG. 11.

An operation of the heat exchanger according to the present invention will be described now hereinafter. When two fluids comprising high temperature fluid and low temperature fluid are respectively supplied into the first heat transfer unit 2 and second heat transfer unit 3 through the first inlet pipe 17 and second inlet pipe 15 by way of an appropriate pressure feeding means, one fluid reaches the inside of the first heat transfer unit 2 through the through holes 8 and strikes against bottom surfaces of the small chambers 5, 5*a* . . . of the smaller diameter disc 7, whereby it is disturbed in its flowing course and is varied in its flowing direction. Further, one fluid strikes against the side walls of the small chambers 5, 5*a* . . . , whereby it is prevented from flowing straight and is varied in its flowing direction, and then it flows through the small chambers 5, 5*a* . . . , which communicate with one another, and it flows while striking, dispersing and meandering radially and outwardly from the central portion of the second heat transfer unit 3.

The fluid which passed through one of the first heat transfer unit 2 flows the fluid passage 20 defined between the inner peripheries of the casing 19 and the closing plates 10 of the second heat transfer unit 3, and then enters the other small chambers 5, 5*a* . . . of the first heat transfer unit 2 from the outside thereof, whereby the fluid repeats the striking, dispersing and meandering operations and it flows centripetally to the center of the first heat transfer unit 2, and it is finally discharged from the first outlet pipe 18.

Likewise, the other fluid reaches the inside of the second heat transfer unit 3 through the pipe attaching holes 12 and flows through the small chambers 5, 5*a* . . . while repeating the aforementioned striking, dispersing and meandering operations, and further flows radially outwardly from the central portion of the second heat transfer unit 3. On the other hand, the fluid which passed through one of the second heat transfer unit 3 flows through the fluid passages 11 defined between the closing plates 10 and the peripheries of the smaller diameter discs 7*a*, and it enters the other small chambers 5, 5*a* . . . of the second heat transfer unit 3 from the outside thereof, whereby the fluid repeats the striking, dispersing and meandering operations are repeated and it flows centripetally to the center of the second heat transfer unit 3, and it is finally discharged outside through the second outlet pipe 16.

As mentioned above, since the fluids repeat the striking, dispersing and meandering operations when they pass through the larger and smaller diameter discs 6, 6*a* and 7, 7*a* of the first and second heat transfer unit 2 and 3, transfer of heat energy can be smoothly performed for the high temperature fluid from the entire thereof so that thermal energy is sharply absorbed by the larger and smaller diameter discs 6 and 7. On the other hand, for the low temperature fluid, heat is transferred from the larger and smaller diameter discs 6 and 7 of the first heat transfer unit 2 to the larger and smaller diameter discs 6*a* and 7*a* of the second heat transfer unit 3 since the former is brought into closer contact with and laid on the latter. The heat energy which is moved to the larger and smaller diameter discs 6*a* and 7*a* of the second heat transfer unit 3 is sharply adsorbed by the low temperature fluid since the heat transfer is performed smoothly from the larger and smaller diameter discs 6*a* and 7*a* to the entire of low temperature fluid, thereby performing the heat transfer.

Since a heat exchanger comprises a cylindrical casing 19, a heat exchanger unit 4 inserted into the casing 19, wherein the exchanger unit 4 being composed of a first and a second heat transfer units 2 and 3 for permitting two fluids having a high temperature and a low temperature to flow therethrough respectively, and wherein the first heat transfer unit 2 concentrically comprising two pairs of larger and smaller diameter discs 6 and 7 each having a plurality of polygonal small chambers 5, 5*a* . . . thereon which are open at fronts thereof, in each pair the larger and smaller diameter discs 6 and 7 being coupled to each other face to face, and wherein the small chambers 5, 5*a* . . . of the larger diameter disc 6 and those of the smaller diameter disc 7 are alternately arranged with one another so as to communicate with one another and the larger and smaller diameter discs 6 and 7 have through holes 8 and 9 formed at centers thereof respectively, the through holes 9 being smaller than the through holes 8 in diameter, the fluids entered from the through holes 8 strike against the bottom surfaces and side walls of the small chambers 5, 5*a* . . . of the smaller diameter disc 7, and it is disturbed in its flowing course and is varied in its flowing direction, then it flows through the small chambers 5, 5*a* . . . which communicate with one another and further flows while repeating radially and centripetally striking, dispersing and meandering operations, whereby heat energy of the fluid can be effectively transferred from the entire of the fluid to the larger and smaller diameter discs 6 and 7 compared with the heat exchange which is performed when the fluid merely contacts and flows though the inner and outer surfaces of the tube. As a result, the fluid has no irregularity in its temperature distribution during the flowing thereof so as to permit the fluid to flow while the temperature distribution is always kept constant, whereby quantity of fluid which does not contact the heat transfer surface can be reduced, thereby remarkably enhancing thermal efficiency compared with the conventional heat exchanger. Further, a continuous fluid passage formed by the aggregating and dispersing flow of the fluid is zigzag, it is possible to lengthen the fluid passage, thereby increasing a contact surface of the fluid. Still further, the continuous passage crosses at right angles with the axial direction of the casing 19, the length of the casing 19 can be reduced, thereby permitting the heat exchanger 1 to be compact as a whole.

Since the second heat transfer unit 3 comprises the second heat transfer unit 3 concentrically comprising two pairs of larger and smaller diameter discs 6*a* and 7*a* each having a plurality of polygonal small chambers 5, 5*a* . . . thereon which are open at fronts thereof, in each pair the larger and smaller diameter discs 6*a* and 7*a* being coupled to each other face to face, wherein the small chambers 5, 5*a* . . . of the larger diameter disc 6 and those of the smaller diameter disc 7 are alternately arranged with one another so as to communicate with one another and the smaller diameter discs 7*a* having pipe attaching holes 12 at centers thereof are concentrically coupled to each other back to back, the attaching holes 12 being smaller in diameter than the through holes 8 of the larger diameter discs 6 of the first heat transfer unit 2, a closing plate 10 provided between peripheries of the larger diameter discs 6*a* positioned at both sides of the second heat transfer unit 3 to form a fluid passage 11 between the closing plate 10 and peripheries of the smaller diameter discs 7*a*, heat energy transferred to the larger and smaller diameter discs 6*a* and 7*a* can be effectively transferred to the fluid which flows in the second heat transfer unit 3, so that the thermal efficiency of the heat exchanger I can be remarkably enhanced as a whole together with the aforementioned effect compared with the prior art heat exchanger.

Still further, since the second heat transfer units 3 are position at the center of the heat exchanger units 4 and rear side surfaces of the smaller diameter discs 7 of the first heat transfer unit 2 are concentrically coupled to rear side surfaces of the larger diameter discs 6*a* of the second heat transfer unit, thereby forming the heat exchanger units 4, the heat exchanger units 4 may be used not only as a single unit but also as a plurality of units continuously coupled to each other, thereby simply coping with the length of fluid passage. Further, since the heat exchanger units 4 are inserted into the casing 19 and peripheries of the large diameter discs 6 of the first heat transfer unit 2 is brought into closer contact with the inner peripheries of the casing 19 so as to form the fluid passages 20, the larger diameter disks 6, 6*a* and smaller diameter discs 7, 7*a* are directly coupled with one another between the second and first heat transfer units 3 and 2, thereby enhancing the transfer of heat energy, and loss of thermal efficiency between the second heat transfer unit 3 and first heat transfer unit 2 can be reduced since the heat energy of the fluids which flow in the fluid passage 20 contact the closing plates 10.

Since second inlet and outlet pipes 15 attached to the attaching holes 12 for permitting one of the fluids having a high and a low temperatures to flow into or out of the second heat transfer unit 3 so as to pass through the through holes 8 and 9 of the smaller and larger diameter discs 7 and 6 of the first heat transfer unit 2 respectively, it is possible to permit the high and low temperature fluids to enter the first heat transfer unit 2 and second heat transfer unit 3, to permit the flowing directions of the two fluids to be the same with or opposite to each other. Still further, when coupling the heat exchanger units 4 continuously to one another, the second inlet and outlet pipes 15 can be used as coupling members for coupling both second heat transfer units 3, and the connection between the first heat transfer units 2 can be made by the through holes 8, thereby easily continuously coupling the heat exchanger units 4.

Still further, since one of the surfaces of the smaller diameter discs 7*a* of the second heat transfer unit 3 where they are coupled to each other is concave and the other is convex so as to be brought into closer contact with each other, and ones of rear surfaces of the larger diameter discs 6*a* of the second heat transfer unit 3 and the smaller diameter discs 7 of the first heat transfer unit 2 in the heat exchanger where they are coupled to each other are concave and the others thereof are convex so as to be brought into closer contact with each other, heat transfer areas between larger diameter discs 6 and 6*a*, and smaller diameter discs 7 and 7*a* can be increased, whereby thermal efficiency can be enhanced between the smaller diameter discs 7*a* of the second heat transfer unit 3 and between the larger diameter disc 6*a* and smaller diameter disc 7 in the heat exchanger units 4, which leads to further enhancement of the thermal efficiency of the heat exchanger 1 as a whole.

Since two smaller diameter discs 7*a* of the second heat transfer unit 3 is replaced with a single smaller diameter disc and each pair of the larger diameter discs 6*a* of the second heat transfer 3 unit and the smaller diameter discs 7 of the first heat transfer unit 2 which are coupled to each other in the heat exchanger is replaced with a single disc, loss of thermal efficiency between the smaller diameter discs 7*a* of the second heat transfer unit 3 and between the larger diameter disc 6*a* and the smaller diameter disc 7 in the heat exchanger unit 4 can be removed, thereby achieving a remarkable practical effect such as enhancement of the thermal efficiency of the heat exchanger 1 as a whole.

What is claimed is:

1. A heat exchanger comprising a cylindrical casing, a heat exchanger unit inserted into said casing, said exchanger unit being composed of a first and a second heat transfer units for permitting two fluids having a high temperature and a low temperature, respectively, to flow therethrough;

said first heat transfer unit concentrically comprising two pairs of larger and smaller diameter discs each having a plurality of polygonal small chambers thereon which are open at fronts thereof, in each pair said larger and smaller diameter discs of said first heat transfer unit being coupled to each other face to face, wherein said small chambers of said larger diameter disc and those of said smaller diameter disc are alternately arranged with one another so as to communicate with one another, and said larger and smaller diameter discs of said first heat transfer unit have through holes formed at centers thereof respectively, said through holes of said smaller diameter disc being smaller in diameter than said through holes of said larger diameter discs;

said second heat transfer unit concentrically comprising two pairs of larger and small diameter discs each having a plurality of polygonal small chambers thereon which are open at fronts thereof, in each pair said larger and smaller diameter discs of said second heat transfer unit being coupled to each other face to face, wherein said small chambers of said larger diameter disc and those of said smaller diameter disc are alternately arranged with one another so as to communicate with one another and said smaller diameter discs of said second heat transfer unit are concentrically coupled to each other back to back, said larger diameter discs of said second heat transfer unit have pipe attaching holes, said attaching holes being smaller in diameter than said through holes of said larger diameter discs of said first heat transfer unit;

a closing plate provided between peripheries of said larger diameter discs positioned at both sides of said second heat transfer unit to form a fluid passage between said closing plate and peripheries of said smaller diameter discs of said second heat transfer unit; wherein said second heat transfer unit is disposed at a central portion of said heat exchange unit, rear side surfaces of said smaller diameter discs of said first heat transfer unit are concentrically coupled to rear side surfaces of said larger diameter discs of said second heat transfer unit to form said heat exchange unit, said heat exchange unit is inserted into said casing to bring said peripheries of said larger diameter discs of said first heat transfer unit into close contact with an inner periphery of said casing so as to form a fluid passage between said closing plate and said inner periphery of said casing; and inlet and outlet pipes attached to said attaching holes for permitting one of said fluids having a high and a low temperature to flow into or out of said second heat transfer unit so as to pass through said through holes of said smaller and larger diameter discs of said first heat transfer unit respectively.

2. A heat exchanger according to claim 1, wherein one of said surfaces of said smaller diameter discs of said second heat transfer unit, where they are coupled to each other, is concave and the other is convex so as to be brought into closer contact with each other.

3. A heat exchanger comprising a cylindrical casing, a heat exchanger unit inserted into said casing, said exchanger unit being composed of a first and a second heat transfer unit, for permitting two fluids having a high temperature and a low temperature, respectively, to flow therethrough;

said first heat transfer unit concentrically comprising two pairs of larger and smaller diameter discs each having a plurality of polygonal small chambers thereon which are open at fronts thereof, in each pair said larger and smaller diameter discs of said first heat transfer unit being coupled to each other face to face, wherein said small chambers of said larger diameter disc and those of said smaller diameter disc are alternately arranged with one another so as to communicate with one another and said larger and smaller diameter discs of said first heat transfer unit have through holes formed at centers thereof respectively, said through holes of said smaller diameter disc being smaller in diameter than said through holes of said larger diameter discs;

said second heat transfer unit concentrically comprising a single smaller diameter disc of said second heat transfer unit with a plurality of polygonal small chambers formed on both of front and rear sides thereof which are open away from said single smaller diameter disc, a pair of larger diameter discs having a plurality of polygonal small chambers thereon which are open at fronts thereof, said plurality of polygonal small chambers of one of said pair of larger diameter discs being positioned facing said plurality of polygonal small chambers found on said front side of said single smaller diameter disc, said plurality of polygonal small chambers of the other of said pair of larger diameter discs being positioned facing said plurality of polygonal small chambers found on said rear side of said single smaller diameter disc, wherein said small chambers of said larger diameter disc facing said small chambers of said single small diameter disc are alternately arranged with one another so as to communicate with one another, said larger diameter discs of said second heat transfer unit have pipe attaching holes, said attaching holes being smaller in diameter than said through holes of said larger diameter discs of said first heat transfer unit;

a closing plate provided between peripheries of said larger diameter discs positioned at both sides of said second heat transfer unit to form a fluid passage between said closing plate and peripheries of said smaller diameter discs of said second heat transfer unit;

wherein said second heat transfer unit is disposed at a central portion of said heat exchange unit, rear side surfaces of said smaller diameter discs of said first heat transfer unit are concentrically coupled to rear side surfaces of said larger diameter discs of said second heat transfer unit to form said heat exchange unit, said heat exchange unit is inserted into said casing to bring said peripheries of said larger diameter discs of said first heat transfer unit into close contact with an inner periphery of said casing so as to form a fluid passage between said closing plate and said inner periphery of said casing; and inlet and outlet pipes attached to said attaching holes for permitting one of said fluids having a high and a low temperatures to flow into or out of said second heat transfer unit so as to pass through said through holes of said smaller and larger diameter discs of said first heat transfer unit respectively.

4. A heat exchanger according to claim 1, wherein one of said rear surfaces of said larger diameter discs of said second heat transfer unit and said smaller diameter discs of said first heat transfer unit in said heat exchanger, where they are coupled to each other, are concave and the others thereof are convex so as to be brought into closer contact with each other.

5. A heat exchanger comprising a cylindrical casing, a heat exchanger unit inserted into said casing, said exchanger unit being composed of a first and a second heat transfer units for permitting two fluids having a high temperature and a low temperature, respectively, to flow therethrough;

said first heat transfer unit concentrically comprising two pairs of larger and smaller diameter discs each having a plurality of polygonal small chambers thereon which are open at fronts thereof, in each pair said larger and smaller discs of said first heat transfer unit being coupled to each other face to face, wherein said small chambers of said larger diameter disc and those of said smaller diameter disc are alternately arranged with one another so as to communicate with one another and said larger discs of said first heat transfer unit have through holes formed at centers thereof respectively, said smaller diameter discs of said first heat transfer unit have attaching holes formed at the centers thereof respectively, said attaching holes of said smaller diameter disc being smaller in diameter than said through holes of said larger diameter discs;

said second heat transfer unit concentrically comprising a pair of discs each having a plurality of polygonal small chambers thereon which are open at fronts thereof, wherein rear sides of said pair of smaller diameter discs of said first heat transfer unit have a second plurality of polygonal small chambers on said rear sides, said second plurality of polygonal small chambers being open at the fronts thereof, said rear sides of said pair of smaller diameter discs of said first heat transfer unit and discs of said second heat transfer unit being coupled to each other face to face, wherein said small chambers of said rear side of said smaller diameter discs of said first heat transfer unit and those of said disc of second heat transfer unit are alternately arranged with one another so as to communicate with one another and said discs of said second heat transfer unit are concentrically coupled to each other back to back;

a closing plate provided between peripheries of said rear side of said smaller diameter discs of said first heat transfer unit positioned at both sides of said second heat transfer unit to form a fluid passage between said closing plate and peripheries of said discs of said second heat transfer unit;

wherein said second heat transfer unit is disposed at a central portion of said heat exchange unit, said heat exchange unit is inserted into said casing to bring said peripheries of said larger diameter discs of said first heat transfer unit into close contact with an inner periphery of said casing so as to form a fluid passage between said closing plate and said inner periphery of said casing; and inlet and outlet pipes attached to said attaching holes for permitting one of said fluids having a high and a low temperatures to flow into or out of said second heat transfer unit so as to pass through said through holes of said larger diameter discs of said first heat transfer unit respectively.

6. A heat exchanger according to claim 3, wherein one of said rear surfaces of said larger diameter discs of said second heat transfer unit and said smaller diameter discs of said first heat transfer unit in said heat exchanger, where they are coupled to each other, are concave and the others thereof are convex so as to be brought into closer contact with each other.

7. A heat exchanger according to claim 5, wherein one of said sides of said discs of said second heat transfer unit, where they are coupled to each other, is concave and the other is convex so as to be brought into closer contact with each other.

* * * * *

UNITED STATES PATENT AND TRADEMARK OFFICE

CERTIFICATE OF CORRECTION

PATENT NO. : 5 582 245

DATED : December 10, 1996

INVENTOR(S) : Tomio Niimi

It is certified that error appears in the above-indentified patent and that said Letters Patent is hereby corrected as shown below:

Column 9, line 56; change "unit," to ---units---.

Signed and Sealed this

Twenty-fourth Day of June, 1997

Bruce Lehman

*Attest:*

BRUCE LEHMAN

*Attesting Officer*

*Commissioner of Patents and Trademarks*